United States Patent [19]

Raeske et al.

[11] 4,307,689

[45] Dec. 29, 1981

[54] GLOW PLUG CONTROL CIRCUIT

[75] Inventors: Frank J. Raeske, Rossford; Robert A. Mahaney, Graytown; Richard E. Callahan, Toledo, all of Ohio

[73] Assignee: Champion Spark Plug Company, Toledo, Ohio

[21] Appl. No.: 181,143

[22] Filed: Aug. 25, 1980

Related U.S. Application Data

[63] Continuation-in-part of Ser. No. 72,644, Sep. 5, 1979, abandoned, and a continuation-in-part of Ser. No. 72,763, Sep. 5, 1979, abandoned.

[51] Int. Cl.[3] ..... F02N 17/00

[52] U.S. Cl. ..... 123/179 H; 123/145 A; 219/499

[58] Field of Search ..... 123/145 A, 179 H, 179 B, 123/179 R, 179 BG; 219/497, 498, 499; 290/38 C

[56] References Cited

U.S. PATENT DOCUMENTS

| | | | |
|---|---|---|---|
| 2,142,210 | 1/1939 | Rippingille | 123/179 H |
| 2,840,067 | 6/1958 | Carlson | 123/145 A |
| 3,551,686 | 12/1970 | Koehler et al. | 290/38 C |
| 4,002,882 | 1/1977 | McCutchen | 219/499 |
| 4,137,885 | 2/1979 | Van Ostrom | 123/179 H |
| 4,177,785 | 12/1979 | Sundeen | 123/179 H |
| 4,188,931 | 2/1980 | Waterhouse | 123/179 B |
| 4,196,712 | 4/1980 | Kawamura et al. | 123/179 BG |

FOREIGN PATENT DOCUMENTS

| | | | |
|---|---|---|---|
| 2913101 | 10/1979 | Fed. Rep. of Germany | 123/179 H |

*Primary Examiner*—P. S. Lall

*Attorney, Agent, or Firm*—John C. Purdue

[57] ABSTRACT

Switch-controlled apparatus for actuating a power switch to enable application of power from an associated power supply to a heater filament of a glow plug in a diesel engine is disclosed. The filament is one which is heated to a predetermined design temperature when a specified voltage is applied thereto. The power source has a supply voltage greater than the specified voltage of the filament. A switch accessible to an operator of the engine is operable in a first position to prevent the application of the supply voltage to the apparatus, operable in a second position to apply the supply voltage through a first terminal of the apparatus, and operable in a third position to apply the supply voltage through the first terminal and through a second terminal of the apparatus and to a starter for the engine. The apparatus comprises means operable, after the switch has been turned from the first to the second position, to actuate the power switch for a preheat time period which varies as an inverse function of available supply voltage and equals the time required to raise the temperature of the filament from ambient temperature to the design temperature. The apparatus also includes means operable, after the preheat time period, to alternately actuate and then deactuate the power switch in a cyclic fashion to maintain the design temperature of the filament for a prestart time period. The apparatus also includes means operable, after turning the switch from the second to the third position, to continue the cyclical actuation and deactuation of the power switch for an afterglow time period predetermined by the amount of time required for smooth engine idling and to minimize engine noise and white smoke emission.

11 Claims, 4 Drawing Figures

GLOW PLUG CONTROL CIRCUIT

REFERENCE TO RELATED APPLICATIONS

This is a continuation-in-part of Application Ser. No. 72,644 and Application Ser. No. 72,763 both filed Sept. 5, 1979 now abandoned.

BACKGROUND OF THE INVENTION

This invention relates to apparatus for applying power to a heater filament of a glow plug projecting into a combustion chamber in a diesel engine. The glow plug is heated by applying a source of power to the heater filament contained therein. The source can be, for example, a conventional vehicle battery which is also used to energize a starter for the engine. The heater glow plug facilitates diesel engine starting by raising the temperature of air in the combustion chamber from ambient temperature to a temperature sufficiently high to start the engine. Therefore, an operator of the engine must wait a relatively substantial period of time before the glow plugs in the engine have been sufficiently heated to facilitate diesel engine starting.

Because the battery is a source of power for the starter and other equipment as well as the heater filament, the voltage level of the battery fluctuates. A decreasing battery voltage lengthens the period of time the operator must wait before the glow plugs have been sufficiently heated. One method of controlling filament temperature is to employ direct temperature feedback from the filament. However, such a method requires more complex and expensive electronic components as well as a direct connection to the filament during the engine operation. Another problem involves deenergizing the filament within some time period after the engine has started to prevent overheating of the filament.

BRIEF DESCRIPTION OF THE INVENTION

The instant invention is based upon the discovery of apparatus for applying power to a heater filament of a glow plug in a diesel engine. The filament is one which is heated to a predetermined design temperature when a maximum specified voltage is applied thereto. The voltage applied by the power source exceeds the maximum specified voltage and causes the temperature of the filament to rise from ambient temperature to the design temperature in a shorter period of time. Therefore, according to the instant invention, the operator of the engine waits a substantially shorter period of time before the glow plugs in the engine have been sufficiently heated to facilitate diesel engine starting. Subsequently, the apparatus prevents the application of the supply voltage after a predetermined preheat time period within which the glow plugs reach the design temperature of the filament. The apparatus compensates for supply voltage instability by varying the preheat time period as an inverse function of the available supply voltage.

The apparatus also includes means operable to modulate the application of the supply voltage. "on", then "off", to maintain the temperature of the filament at the design temperature. The apparatus compensates for supply voltage instability by varying the duty cycle of the modulation as an inverse function of the available supply voltage. The apparatus also includes means operable to continue modulation for a predetermined afterglow time period commencing after a starter of the engine has been engaged. All the above-mentioned functions are predetermined, for example, by means of digital or analog circuitry. Consequently, direct temperature feedback from the filament is not employed and direct connection between the apparatus and the filament are not required after the starter of the engine has been engaged.

OBJECTS OF THE INVENTION

It is an object of the invention to provide apparatus for applying power to a heater filament of a glow plug in a diesel engine.

It is a further object of the invention to provide apparatus for applying power to a heater filament of a glow plug in a diesel engine that minimizes the amount of time required to heat the glow plug to a predetermined design temperature.

DETAILED DESCRIPTION OF THE INVENTION

Figure 1:
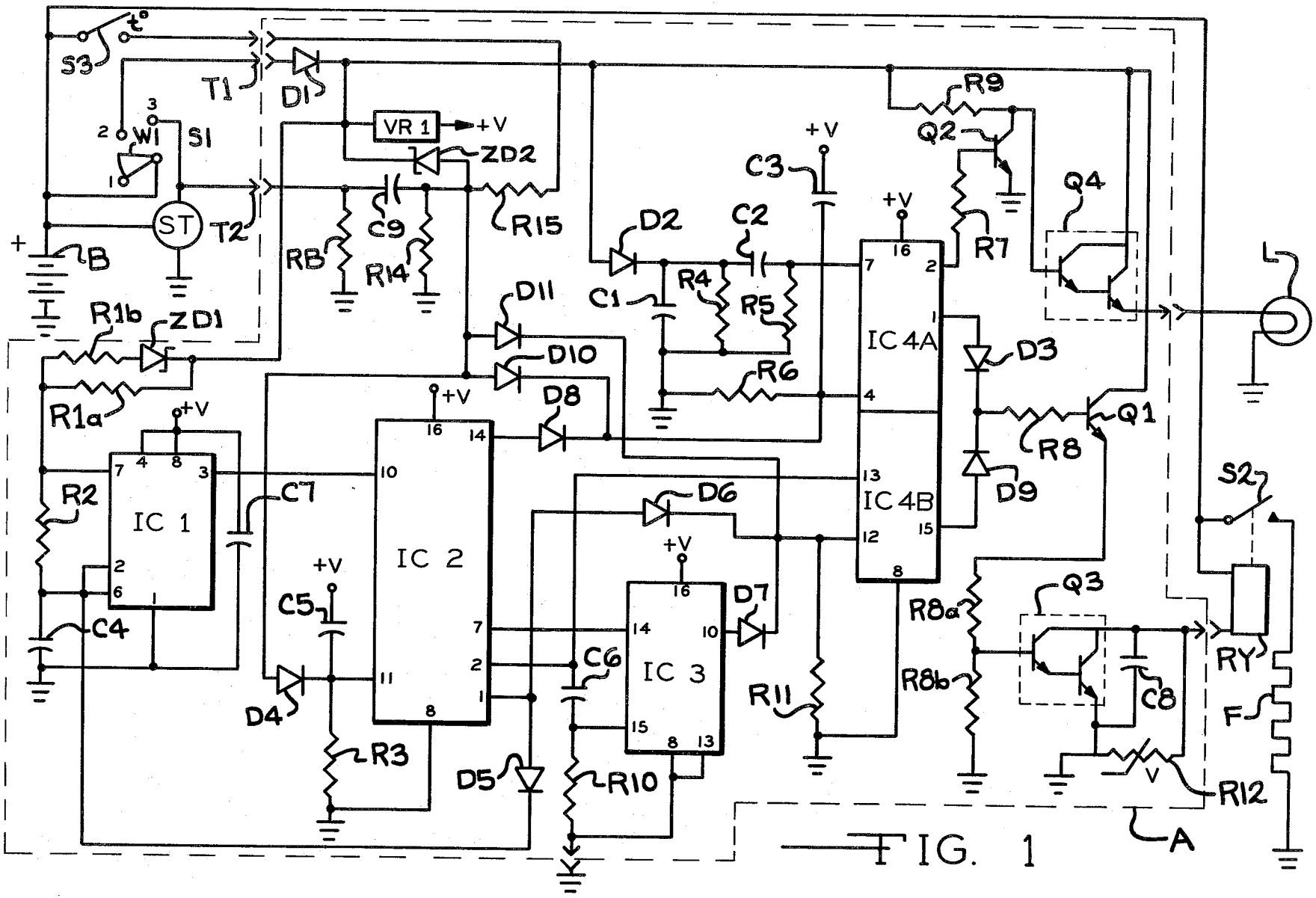
FIG. 1 is a schematic circuit diagram of apparatus for applying power to a heater filament of a glow plug in a diesel engine.

Referring now in more detail to FIG. 1, apparatus for applying power to a heater filament F of a glow plug in a diesel engine is referenced by a dashed line A and comprises the arrangement of electronic components shown therein. A power source B is a conventional vehicle battery, for example, of twelve volts, the positive terminal of which is connected in series with a normally-open switch S2 of a relay RY and the heater filament F. The positive terminal of battery B is also connected to the relay RY, a starter ST for the diesel engine and a movable wiper contact W1 of an ignition switch S1 which is accessible to an operator of the engine. The movable wiper contact W1 is operable in an OFF position 1 to prevent application of the battery voltage to the apparatus, operable in a PREHEAT position 2 to apply the battery voltage through a first terminal T1 of the apparatus and operable in a START position 3 to apply the battery voltage through the first terminal T1 and a second terminal T2 of the apparatus and the starter ST for the engine. The ignition switch S1 automatically returns the movable wiper W1 from the START position 3 to the PREHEAT position 2 after the switch SW has been released by the operator.

When the movable wiper contact W1 of the ignition switch S1 is turned from the OFF position 1 to the PREHEAT position 2, a current from the battery B flows through a diode D1 (type 1N4001) which prevents damage to the apparatus A if the battery polarity is reversed. The current flowing through the diode D1 enables the full battery voltage to be applied to three segments of the apparatus A: a voltage regulator VR1, an oscillator circuit, and means for applying the battery voltage to the filament F and to signal means for the operator of the engine. The voltage regulator VR1, which can be any of the conventional voltage regulating circuits well known in the art, provides a substantially constant potential V of 5 volts to all points of the apparatus A labeled V.

The oscillator circuit comprises an oscillator IC1 which may be type 1455 marketed by Motorola and RCA; a zener diode ZD1 (type 1N756); capacitors C4 (1.0 microfarad) and C7 (0.05 microfarad); and resistors R1*a* (68 Kohms), R1*b* (12 Kohms) and R2 (4.7 Kohms). The capacitor C7, having one end connected to terminals 4 and 8 of the oscillator IC1 and another grounded end connected to the terminal 1 of the oscillator IC1, prevents oscillator instability. The resistor R1*a* is connected in parallel combination with the resistor R1*b* and the zener diode ZD1 serially connected thereto. When the battery voltage is low, the zener diode ZD1 disables current flow through the resistor R1*b* for a total resistance, R1, equal to the value of the resistor R1*a*. However, when the battery voltage is high, the zener diode ZD1 enables current flow through the resistor R1*b* for a total resistance, R1, approximately equal to the parallel combination of the resistors R1*a* and R1*b*. The current flowing from the diode D1 also flows through the total resistance, R1, to an input terminal 7 of the oscillator IC1 and to the resistor R2, the other end of which is connected to the input terminals 2 and 6 of the oscillator IC1 and to the capacitor C4. The other end of the capacitor C4 and the terminal 1 of the oscillator IC1 are grounded. The circuit provides a time-varying output signal comprising a series of pulses at the terminal 3 of the oscillator IC1. The period of each cycle in seconds approximately equals C4 times the sum R1 and twice R2 and has an on-off ratio equal to the sum of resistances R1 and R2 divided by the resistance R2. Since the rate of charge varies as a function of the applied voltage, the repetition frequency of the output signal is, in effect, voltage dependent, i.e., if the battery voltage decreases, the frequency of the oscillator IC1 decreases and if the battery voltage increases, the frequency of the oscillator IC1 increases.

The circuitry for applying the battery voltage to the filament F and to the signal means comprises a first storage resistor IC4A which may be a first flip-flop of type 4027 marketed by Motorola and RCA; diodes D2 and D3 (both type 1N458A); resistors R5 (47 Kohms), R7 and R8 (both 4.7 Kohms), R8*a* (220 ohms), R8*b* (1.0 Kohms) and R9 (470 ohms); a capacitor c2 (0.05 microfarad); and transistors Q1 and Q2 (both type 2N4401), and driver transistors Q3 and Q4 (both type TIP122). The current flowing from the diode D1 also flows through the diode D2 to the capacitor C2, the other end of which is connected to the grounded resistor R5 and the input terminal 7 of the first storage register IC4A. The capacitor C2 provides a positive pulse to set the input terminal 7, while the resistor R5 biases the set input low between pulses. This signal causes an output signal at terminals 1 and 2 of the first storage register IC4A to go high and low, respectively.

The high output signal forward-biases the diode D3 enabling current flow through the resistor R8 into the base of the transistor Q1. The current flow results in a corresponding collector current flow from the diode D1 through the resistor R8*a* into the base of the driver transistor Q3 biased by the resistor R8*b*. This results in collector current flow through the field windings of the relay RY which closes the normally-open relay switch S2 to energize the filament F with the battery B as described hereinabove. The output of the driver Q3 is protected from transients by the parallel combination of a capacitor C8 (0.05 microfarad) and a varistor R12. The low output signal flows through the resistor R7 into the base of the transistor Q2 which diverts current flow from the diode D1 and the resistor R9 into the base of the driver transistor Q4. The current flow results in a corresponding collector current flow from the diode D1 to a wait-lamp L which apprises the operator of the engine that the glow plug is being heated by the energized filament F.

The circuitry for preventing application of the battery voltage to the filament F comprises a first counter IC2 which may be type 4040 marketed by Motorola and RCA; a diode D8 (type 1N458A); capacitors C3 and C5 (both 0.01 microfarad); and resistors R3 and R6 (both 47 Kohms). Pulses from the output terminal 3 of the oscillator IC1 are applied to a clock terminal 10 of the counter IC2 which is initialized at the terminal 11 by the capacitor C5 and held low between signals by the resistor R3. The other end of the resistor R3 is connected to the ground terminal 8 of the counter IC2. An output signal at the terminal 14 goes high after the counter IC2 tallies a predetermined number of pulses generated by the oscillator IC1 over a period of about seven seconds. The high signal from the terminal 14 of the counter IC2 forward-biases the diode D8 to reset the storage register IC4A at the terminal 4 which was initialized by the capacitor C3 and held low by the grounded resistor R6 between pulses. This signal causes the output signals at terminals 1 and 2 of the storage register IC4A to go low and high, respectively. The low output signal turns off the collector current flow of the transistors Q1 and Q3 which deenergize the relay RY enabling the relay switch S2 to disconnect the battery voltage from the filament F. The high output signal enables collector current flow of the transistor Q2 which disables the driver transistor Q4 and deenergizes the wait-lamp L apprising the operator that the starter ST can be engaged.

Figure 2:
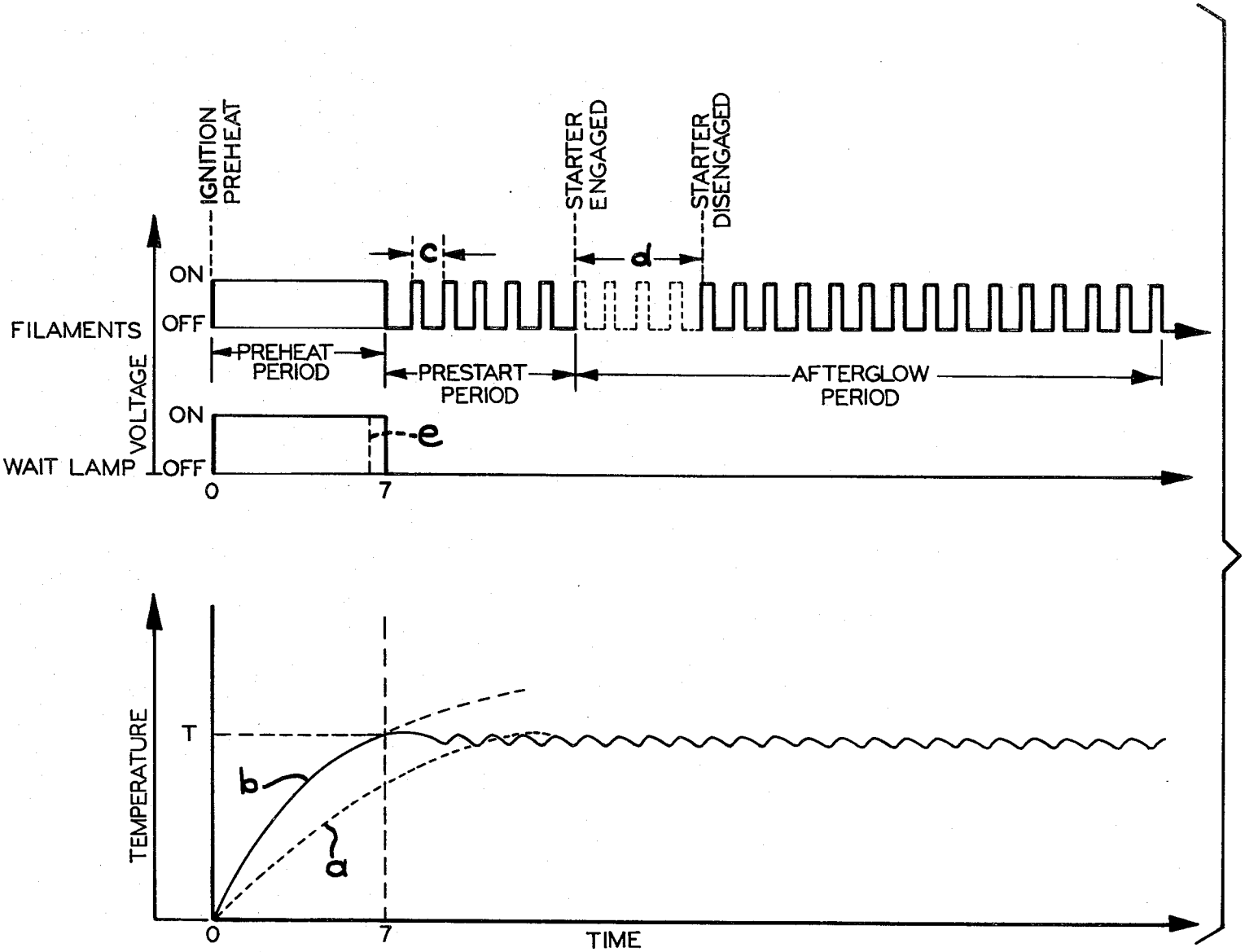
FIG. 2 is a graph showing the time-varying signals being applied to the filament of the glow plug and a wait lamp, and also showing the corresponding time-varying temperature of the filament.

Referring to FIG. 2, the apparatus A in operation applies the battery voltage to the filament F of the glow plug and to the wait-lamp L when the movable wiper contact W1 of the ignition switch S1 is turned from the OFF position 1 to the PREHEAT position 2 as described above. The filament F is one which is heated to a predetermined design temperature T, when a maximum specified voltage of six volts is applied thereto (dashed curve a). Since the twelve volt battery voltage exceeds the maximum specified voltage, the temperature of the filament F rises from ambient temperature to the design temperature, T, in a shorter period of time, e.g., seven seconds (solid portion of curve b). To preclude overheating the filament F after it reaches the design temperature, T (dashed portion of curve b), the application of the battery voltage to the filament F and the wait-lamp L is prevented by the counter IC2 after a predetermined preheat time period of approximately seven seconds.

Although the preheat time period is, as stated, approximately seven seconds, it varies in an inverse relation with the voltage of the battery B. As discussed above, the repetition frequency of the oscillator IC1 is proportionally dependent upon the voltage delivered by the battery B. Therefore, when the voltage is decreased, the oscillator IC1 generates pulses at a slower rate. As a result, a longer period of time elapses before the first counter IC2 tallies the predetermined number of pulses. Hence, a decreased battery voltage is applied to the filament F for an increased preheat time period to achieve the same design temperature, T, that would have been achieved had the battery voltage not decreased. The preheat time period varies in a similar inverse relation to an increased battery voltage.

When the preheat period expires, the wait-lamp L is deenergized to apprise the operator that the engine is ready to start, as discussed above. To give the operator enough time to start the engine after the preheat time period, the apparatus A also comprises circuitry for alternately applying the battery voltage and then interrupting application of the battery voltage to the filament F. This is done in a cyclic fashion to maintain the design temperature, T, of the filament F for a prestart time period not to exceed a predetermined value. The circuitry comprises the first counter IC2, a second counter IC3 which may be type 4017 marketed by Motorola and RCA, and a second storage register IC4B which may be a second flip-flop of type 4027 marketed by Motorola and RCA; diodes D5, D6, D7 and D9 (all type 1N458A); resistors R10 and R11 (both 47 Kohms); and, a capacitor C6 (0.01 microfarad). When the first counter IC2 tallies a predetermined number of pulses, an output signal at the terminal 2 goes high. This signal is fed to a clock terminal 13 of the storage register IC4B causing an output signal at the terminal 15 to go high. This signal forward-biases the diode D9 enabling current flow through the resistor R8 to the base of the transistor Q1 which ultimately causes the relay RY to energize the filament F as described above.

The signal at the terminal 2 is also fed through the capacitor C6 to the resistor R10 and the input terminal 15 of the counter IC3 which was initialized by the capacitor C6 and held low between signals by the resistor 10. The other end of the resistor R10 and terminals 8 and 13 of the counter IC3 are grounded. When the first counter IC2 tallies a predetermined number of pulses after the output signal at the terminal 2 goes high, an output pulse from the terminal 7 is applied directly to the clock terminal 14 of the second counter IC3. When the second counter IC3 has tallied a specifically desired number of pulses, the output terminal 10 goes high. This signal forward-biases the diode D7 which enables current flow to the reset terminal 12 of the second storage register IC4B and to the resistor R11 which holds the reset low between pulses. As a result, the output signal at the terminal 15 goes low and turns off the collector current flow of the transistor Q1 which ultimately causes the relay RY to deenergize the filament F as described above.

The predetermined number of pulses, which causes the output signal at the terminal 2 of the first counter IC2 to go high, defines the period of a cycle in which the pulse width is defined by the predetermined number of pulses which causes the output signal at the terminal 10 of the second counter IC3 to go high. This cycle of energizing, then deenergizing the filament F, as illustrated in FIG. 2 by a pulse in time period c, repeats to produce a train of voltage pulses for application to the filament F. This modulating action limits the average power to maintain the design temperature of the filament F without overheating it. The first counter IC2 disables modulation after a maximum prestart time period of approximately 30 seconds. This is accomplished when the output terminal 1 goes high and forward-biases the diode D5 enabling current flow to input terminals 2 and 6 of the oscillator IC1 which is disabled by the constant charge held on the capacitor C4 by the diode D5. The signal at the terminal 1 of the first counter IC2 is also fed through the diode D6 to the reset terminal 12 of the second storage register IC4B which causes the output signal at the terminal 15 to go low to deenergize the filament F. Since the oscillator IC1 is stopped and the filament F is deenergized, the apparatus A cannot be restarted until the movable wiper contact W1 of the ignition switch S1 is turned back from the PREHEAT position 2 to the OFF position 1.

When the operator returns the movable wiper contact W1 of the ignition switch S1 to the PREHEAT position 2 immediately after the prestart period, the filament F would be reheated to a temperature greater than the design temperature before it was able to cool down to ambient temperature. To prevent reheating the filament F for a second preheat time period, a capacitor C1 (33 microfarads), which has been charged through the diode D2, is discharged across a parallel resistor R4 (5.6 Mohms) whenever the movable wiper contact W1 of the ignition switch S2 is turned back from the PREHEAT position 2 to the OFF position 1. The values of the resistor R4 and the capacitor C1 set the time constant at a sufficiently low discharge rate with respect to the capacitor C2 to prevent a signal from being applied to the input terminal 7 of the first storage register IC4A for a time period of approximately one to three minutes. Therefore, even though the operator returns the wiper contact W1 to the PREHEAT position 2, battery voltage will not be applied to the filament F for a second preheat time period unless the above-mentioned time period has expired.

However, if the operator engages the starter ST by turning the wiper contact W1 of the ignition switch S1 from the PREHEAT position 2 to the START position 3 before the prestart period expires, the current which is still flowing through the diode D1 also flows to the starter ST of the engine and a wave-shaping circuit comprising a capacitor C9 (0.047 microfarad) and resistors R13 and R14 (both 15 Kohms). The current flows to the grounded resistor R13 and the capacitor C9, the output end of which is connected to the grounded resistor R14 and diodes D4, D10 and D11 (all type 1N458A) enabling a pulse of short duration to reset the first counter IC2 and both storage registers IC4A and IC4B at terminals 11, 4 and 12, respectively. The signal at the terminal 11 of the first counter IC2 enables continued modulation of the battery voltage to the filament F for an afterglow period of approximately 30 seconds. However, if the resistor R13 is eliminated, it will be appreciated that a resistor (not shown) can be substituted for the capacitor C9 to hold the signal high at the terminal 11 of the first counter IC2. This signal would prevent modulation until the starter ST was disengaged by releasing the ignition switch S1 as shown in FIG. 2 by the dashed pulses occurring in time period d. Nevertheless, if the engine starts, the glow plugs remain heated while the engine is operating. The afterglow period is predetermined by the amount of time required for smooth engine idling and to minimize engine noise and white smoke emission.

The apparatus A also includes a normally-open thermostat S3 connected between the positive terminal of the battery B and a resistor R15 (47 Kohms) which is connected to the output of the wave-shaping circuit. When the temperature of the engine exceeds a specified value, t, the thermostat S3 closes and causes current flow to the diodes D4, D10 and D11 through the resistor R15 which holds the signal high at terminals 11, 4 and 12 of the first counter IC2 and both storage registers IC4A and IC4B, respectively. Consequently, modulation of the battery voltage applied to the filament is prevented until the engine cools to a temperature below the specified value, t, enabling the thermostat S3 to return to its normally-open position. The apparatus A also includes a zener diode ZD2 (type 1N759) connected between the diode D1 and the output of the wave-shaping circuit. Whenever the battery voltage exceeds 15 volts, the zener diode ZD2 enables current flow through the diodes D4, D10 and D11 to deactivate the first counter IC2 and both storage registers IC4A and IC4B at terminals 11, 4 and 12, respectively. Consequently, modulation is prevented until the voltage no longer exceeds 15 volts.

Figure 3:
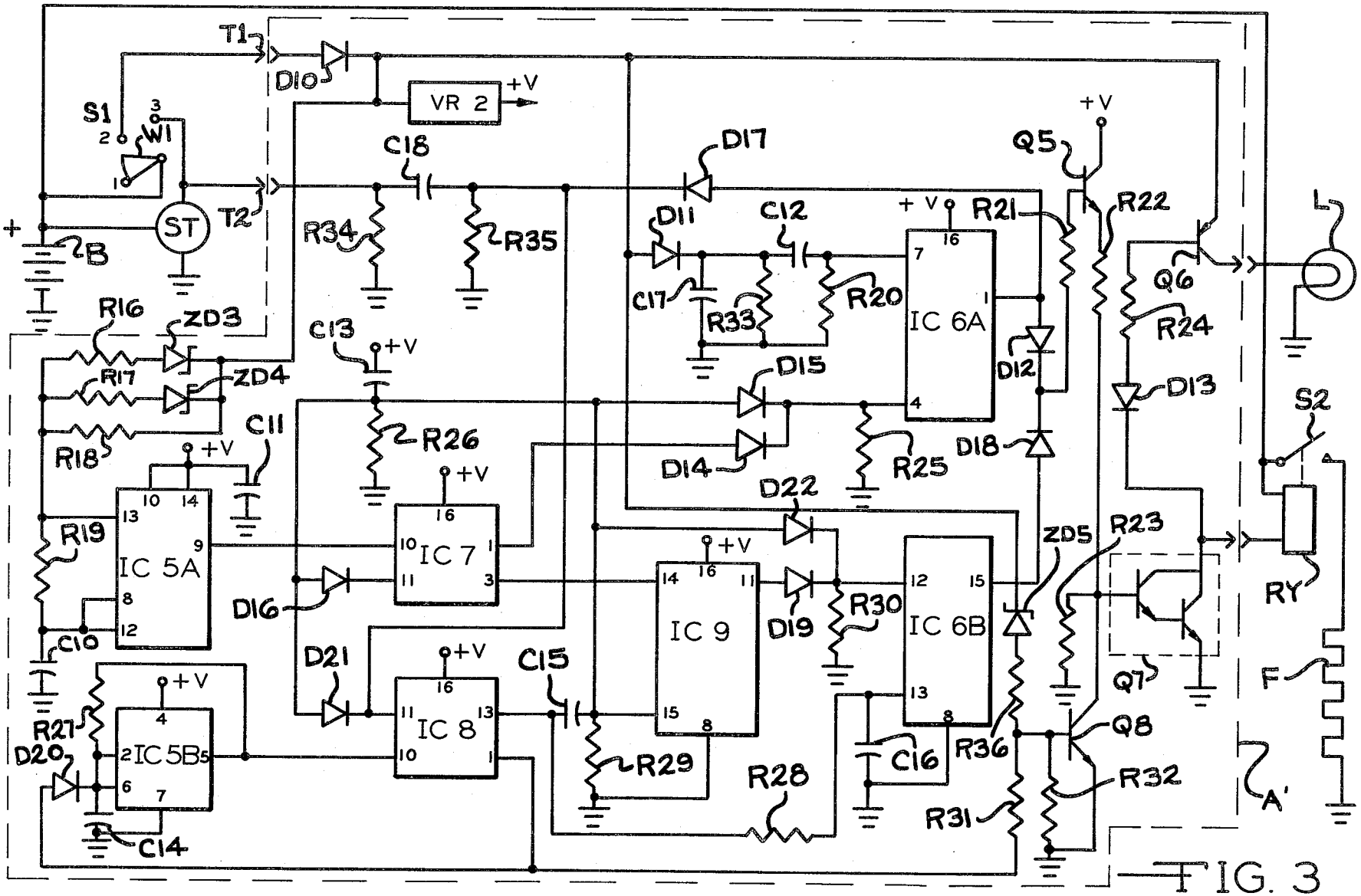
FIG. 3 is a schematic circuit diagram of another embodiment of apparatus according to the invention.
Figure 4:
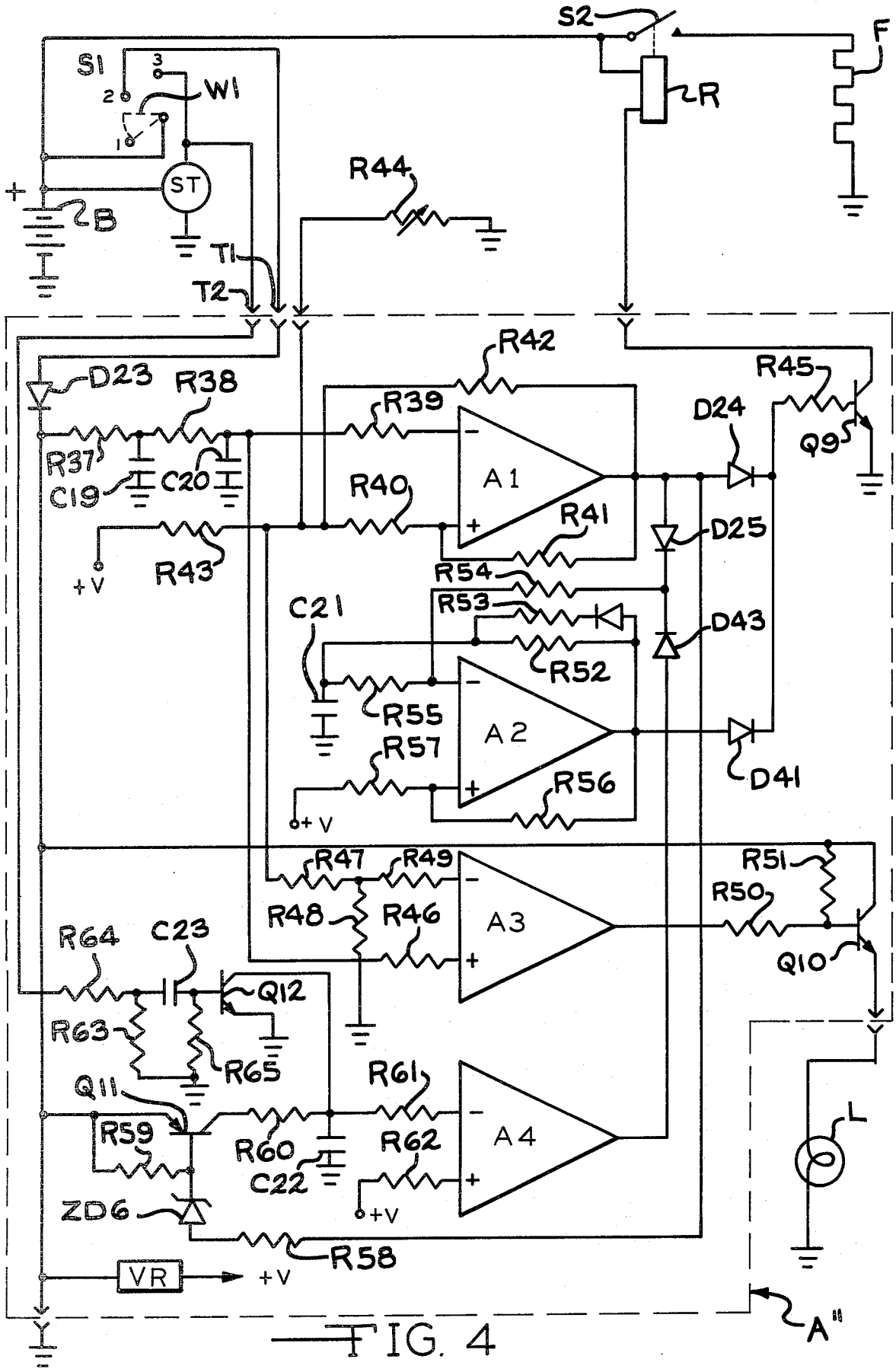
FIG. 4 is a schematic circuit diagram of still another embodiment of apparatus according to the invention.

Another embodiment of the apparatus according to the invention is referenced by a dashed line A' in FIG. 3 and comprises the arrangement of electronic components shown therein. When the movable wiper contact W1 of the ignition switch S1 is turned from the OFF position 1 to the PREHEAT position 2, a current from the battery B flows through a diode D10 (type 1N4001) which prevents damage to the apparatus A' if the battery polarity is reversed. The current flowing through the diode D10 enables the full battery voltage to be applied to three segments of the apparatus A': a voltage regulator VR2, a first oscillator circuit, and means for applying the battery voltage to the filament F and to signal means for the operator of the engine. The voltage regulator VR2, which can be any of the conventional voltage regulating circuits well known in the art, provides a substantially constant potential V of 5 volts to all points of the apparatus A' labeled V.

The first oscillator circuit comprises a first oscillator IC5A which may be a first timer of type 556 marketed by Intersil; zener diodes ZD3 (type 1N758) and ZD4 (type 1N754); resistors R16 (150 Kohms), R17 (100 Kohms), R18 (110 Kohms) and R19 (270 ohms); and capacitors C10 (0.22 microfarad) and C11 (0.05 microfarad). The grounded capacitor C11 is connected to terminals 10 and 14 of the first oscillator IC5A to prevent instability thereof. The current flowing through the diode D10 also flows to one end of a parallel combination of the reverse-biased zener diode ZD3 and its serially connected resistor R16, the reversed biased zener diode ZD4 and its serially connected resistor R17, and the resistor R18. The other end of the parallel combination is connected to the discharge terminal 13 of the oscillator IC5A and to the resistor R19, the other end of which is connected to terminals 8 and 12 of the oscillator IC5A and the grounded capacitor C10. The circuit provides a time-varying output signal comprising a series of pulses at the output terminal 9 of the oscillator IC5A. Each cycle comprises an "off" state and an "on" state, the former being a function of a constant discharge rate determined by the resistor R19 and the capacitor C10, the latter being a function of a variable charging rate determined by the battery voltage. When the battery voltage is not greater than 10 volts, the rate of charge is a function of (C10) (R18+R19). However, when the battery voltage is greater than 10 volts but not greater than 13 volts, the zener diode ZD4 enables current flow through the resistor R17; when the battery voltage is greater than 13 volts, the zener diode ZD3 enables current flow through the resistor R16. Therefore, the repetition frequency of the output signal is voltage dependent, i.e., if the battery voltage decreases, the frequency of the oscillator IC5A decreases, and if the battery voltage increases, the frequency of the oscillator IC5A increases.

The circuitry for applying the battery voltage to the filament F and to the signal means comprises a first storage register IC6A which may be a first flip-flop of type 4027 marketed by Motorola and RCA; diodes D11, D12 and D13 (all type 1N458A); resistors R20 (47 Kohms), R21 (47 K ohms), R22 (220 ohms), and R23 and R24 (both 1.0 Kohms); a capacitor C12 (0.05 microfarad); and, transistors Q5 (type 2N4401) and Q6 (type TIP127), and a driver transistor Q7 (type TIP122). The current flowing from the diode D10 also flows through the diode D11 to the capacitor C12, the other end of which is connected to the grounded resistor R20 and the input terminal 7 of the first storage register IC6A. The capacitor C12 provides a positive pulse to set the input terminal 7, while the resistor R20 biases the set input low between pulses. This signal causes an output signal at the terminal 1 of the first storage register IC6A to go high. The high output signal forward-biases the diode D12 enabling current flow through the resistor R21 into the base of the transistor Q5. The current flow results in a corresponding collector current flow from the voltage regulator VR2 through the resistor R22 into the base of the driver transistor Q7 biased by the resistor R23. This results in collector current flow through the field windings of the relay RY which closes the normally-open relay switch S2 to energize the filament F as described hereinabove. The collector current flow of the driver transistor Q7 also forward biases the diode D13 enabling current flow from the base of the transistor Q6 through the resistor R24. This results in a corresponding emitter current flow from the diode D10 to the wait-lamp L which apprises the operator of the engine that the glow plug is being heated by the energized filament F.

The circuitry for preventing application of the battery voltage to the filament F comprises a first counter IC7 which may be type 4040 marketed by Motorola and RCA, a diode D14 (type 1N458A), and a resistor R25 (47 Kohms). A master reset circuit comprising a capacitor C13 (0.05 microfarad) connected to a grounded resistor R26 (22 Kohms) produces a voltage spike at the junction of the capacitor C13 and the resistor R26 initializing both the first storage register IC6A at the terminal 4 and the first counter IC7 at the terminal 11 through diodes D15 and D16 (both type 1N458A), respectively. Pulses from the output signal at the terminal 9 of the oscillator IC5A are applied to the clock terminal 10 of the first counter IC7. An output signal at the terminal 1 of the counter IC7 goes high after the counter IC7 tallies a predetermined number of pulses generated by the oscillator IC5A over a period of about seven seconds. The high signal from the terminal 1 of the counter IC7 forward-biases the diode D14 to reset the storage register IC6A at the terminal 4 biased by the grounded resistor R25. This signal causes the output signal at the terminal 1 of the storage register IC6A to go low. The low output signal turns off the collector current flow of the transistors Q5 and Q7 which deenergizes the relay RY enabling the relay switch S to disconnect the battery voltage from the filament F. Turning off the collector current flow of the driver transistor Q7 also deenergizes the wait-lamp L apprising the operator that the starter ST can be engaged. Referring to FIG. 2, the apparatus A' operates in the same manner during the preheat time period as does the apparatus A described hereinabove.

The circuitry for alternately applying the battery voltage to the filament F and then interrupting its application in a cyclic fashion maintains the design temperature of the filament F for a predetermined, prestart time period. The circuitry comprises a second oscillator IC5B which may be a second timer of type 556 marketed by Intersil, a second counter IC8 which may be type 4040 and a third counter IC9 which may be type 4017, both marketed by Motorola and RCA, and a second storage register IC6B which may be a second flip-flop of type 4027 marketed by Motorola and RCA; diodes D17, D18, D19 and D20 (all type 1N458A); resistors R27 and R28 (both 15 Kohms) and R29 and R30 (both 47 Kohms); and, capacitors C14 (0.47 microfarad), C15 (0.01 microfarad) and C16 (0.05 microfarad). The resistor R27 is connected between the output terminal 5 of the oscillator IC5B and terminals 2 and 6 thereof, and the capacitor C14 is connected between terminals 2 and 6 of the oscillator IC5B and the grounded terminals 7 thereof. When the output terminal 1 of the first storage register IC6A goes low at the end of the preheat time period, the diode D17 connected thereto disables current flow to the reset terminal 11 enabling the counter IC8 to tally pulses received at a constant rate from the output terminal 5 of the oscillator IC5B. Both the counter IC8 at the terminal 11 and the second storage register IC6B at the terminal 12 were initialized by the master reset circuit through diodes D21 and D22, respectively. After the counter IC8 tallies a predetermined number of pulses, an output signal at the terminal 13 goes high enabling current flow through the resistor R28 to the grounded capacitor C16 and the terminal 13 of the second storage register IC6B grounded at the terminal 8. This causes an output signal at the terminal 15 to go high forward-biasing the diode D18 enabling current flow through the resistor R21 to the base of the transistor Q5 which ultimately causes the relay RY to energize the filament F as described hereinabove. Although the filament F is deenergized for a fixed period of time because of the fixed frequency of the oscillator IC5B, it is energized for a variable period of time depending on the battery voltage.

The high signal from the terminal 13 of the second counter IC8 is also fed through the capacitor C15 to a grounded resistor R29 and to the terminal 15 of the third counter IC9 initialized by the master reset circuit at the terminal 15. This signal enables the third counter IC9 to begin tallying pulses received at the terminal 14 from the output terminal 16 of the first counter IC7. After the third counter IC9 tallies a predetermined number of pulses, an output signal at the terminal 11 goes high and forward-biases the diode D19 enabling current flow of the terminal 12 of the second storage register IC6B. As a result, the output signal at the terminal goes low and turns off the collector current flow of the transistor Q5 which ultimately causes the relay RY to deenergize the filament F as described hereinabove. The amount of time the filament F remains energized varies in an inverse relation with voltage of the battery B. As discussed above, the repetition frequency of the first oscillator IC5A is proportionally dependent upon the voltage delivered by the battery B. Therefore, when the voltage decreases, the first oscillator IC5A generates pulses at a slower rate. As a result, a longer period of time elapses before the first counter IC7 tallies the predetermined number of pulses. Hence, a decreased battery voltage is applied to the filament for an increased period of time to achieve the same design temperature that would have been achieved had the battery voltage not decreased. The amount of time that the filament F remains energized varies in a similar inverse relation to an increased battery voltage.

The predetermined number of pulses, which causes the output signal at the terminal 13 of the second counter IC8 to go high, defines the period of a cycle in which the pulses width is defined by the predetermined number of pulses which causes the output signal at the terminal 11 of the third counter IC9 to go high. Since the pulses width, representing the amount of time that the filament F remains energized, varies in an inverse relation with the voltage of the battery B, so also does the duty cycle. This cycle of energizing, then deenergizing the filament F, repeats to produce a train of voltage pulses for application to the filament F. The variable duty cycle, as well as this modulating action, limits the average power supplied to maintain the design temperature of the filament F without overheating it. The second counter IC8 disables modulation after a maximum prestart time period of approximately 30 seconds. This is accomplished when the output terminal 1 goes high and forward-biases the diode D20 enabling current flow to input terminals 2 and 6 of the second oscillator IC5B which is disabled by the constant charge held on the capacitor C14 by the diode D20. The signal at the terminal 1 of the second counter IC8 is also fed through a resistor R31 (4.7 Kohms) into the base of a transistor Q8 (type 2N4401) biased by a resistor R32 (15 Kohms). This causes collector current flow which diverts current flow from the base of the driver transistor Q7 and turns off its collector current flow which ultimately causes the relay RY to deenergize the filament F as described hereinabove. Since the second oscillator IC5B is stopped and the filament is deenergized, the apparatus A′ cannot be restarted until the movable wiper contact W1 of the ignition switch S1 is turned back from the PREHEAT position to the OFF position 1.

When the operator returns the movable contact W of ignition switch S1 to the PREHEAT position 2 immediately after the prestart period, the filament F would be reheated to a temperature greater than the design temperature as describe hereinabove. To prevent reheating, a capacitor C17 (33 microfarads), which has been charged through the diode D11, is discharged across a parallel resistor R33 (5.6 M ohms) whenever the movable contact W1 of the ignition switch S2 is turned back from the PREHEAT position 2 to the OFF position 1. The values of the resistor R33 and the capacitor C17 set the time constant at a sufficiently low discharge rate with respect to the capacitor C12 to prevent a signal from being applied to the input terminal 7 of the first storage register IC6A for a time period of approximately one to three minutes. Therefore, even though the operator returns the wiper contact W1 to the PREHEAT position 2, battery voltage will not be applied to the filament F unless the above-mentioned time period has expired.

However, if the operator engages the starter ST by turning the wiper contact W1 of the ignition switch S1 from the PREHEAT position 2 to the START position 3 before the prestart time period expires, the current which is still flowing through the diode D10 also flows to the starter ST of the engine and a wave-shaping circuit comprising a capacitor C18 (0.05 microfarad) and resistors R34 and R35 (both 15 Kohms). The current flows to the grounded resistor R34 and the capacitor C18, the output end of which is connected to the grounded resistor R35 and the terminal 11 of the second counter IC8 which is reset by a pulse of short duration. As a result, modulation of the battery voltage to the filament F continues for an afterglow period of approximately 30 seconds. However, if the resistor R13 is eliminated, it will be appreciated that a resistor (not shown) can be substituted for the capcitor C18 to hold the signal high at the terminal 11 of the second counter IC8. This signal would prevent modulation until the starter ST was disengaged by releasing the ignition switch S1 as shown in FIG. 2 by the curve during time d. Nevertheless, if the engine starts, the glow plugs remain heated as discussed hereinabove.

The apparatus A' also includes a forward-biased zener diode ZD5 (type 1N759) and a serially connected resistor R36 (22 Kohms) connected between the diode D10 and the base of the transistor Q8. Whenever the battery voltage exceeds 15 volts, collector current flow of the transistor Q8 causes the collector current flow of the driver transistor Q7 to be turned off which ultimately causes the relay RY to deenergize the filament F as described above.

Another embodiment of the apparatus according to the invention is referenced by a dashed line A" and comprises the arrangement of electronic components shown therein. When the movable wiper contact W1 of the ignition switch S1 is turned from the OFF position 1 to the PREHEAT position 2, current from the battery B flows to a diode D23 (type 1N4001) and four operational amplifiers A1, A2, A3 and A4. The diode D23 prevents damage to the apparatus A" if polarity of the battery is reversed. Current flowing through the diode 23 enables the full battery voltage to be applied to five segments of the apparatus A": a voltage regulator VR, a trigger circuit, a filament switching circuit, a signal switching circuit, and a prestart circuit. The voltage regulator VR, which can be any of the conventional voltage regulating circuits well known in the art, provides a substantially constant potential V of five volts to all points of the apparatus A" labeled V. The four operational amplifiers A1, A2, A3 and A4 are fabricated in a single integrated circuit, which may be a National Semiconductor LM3301, and powered by two integrated circuit terminals (not illustrated). Each of the amplifiers A1, A2, A3 and A4 has inverting (−) and noninverting (+) input terminals and an output terminal reflecting the difference therebetween.

The trigger circuit comprises capacitors C19 and C20 (5 and 33 microfarads, respectively) and resistors R37 and R38 (100 and 390 Kohms, respectively). The current flowing through the diode D23 also flows through the resistor R37 to the grounded capacitor C19 and the resistor R38. The output end of the resistor R38 is connected to the grounded capacitor C20 and a hysteretic differential comparator comprising the operational amplifier A1, resistors R39, R40 (both 2.7 M ohms) and a feedback resistor R41 connected between the output and the noninverting terminals of the amplifier A1. The resistor R37 and the capacitor C19 suppress high frequency interference and have a negligible effect on the charge rate of the capacitor C20. The increase in voltage across the capacitor C20 is dependent upon the product of its capacitive value and the value of the resistor R38 and is directly proportional to the available battery voltage. As the capacitor C20 is being charged, a slowly increasing trigger current flows from the output end of the resistor R38 through the resistor R39 to the inverting terminal of the operational amplifier A1.

The trigger current is compared to a reference current provided by circuitry comprising resistors R42 and R43 (470 and 100 Kohms, respectively) and a temperature sensor R44. Current flowing from the voltage regulator VR flows through the resistor R43 to the resistor R40 connected to the noninverting terminal of the amplifier A1. Current flowing from the output of the amplifier A1 through the resistor R42 also flows to the resistor R40, as well as the grounded temperature sensor R44. Therefore, the reference current into the resistor R40 is equal to the sum of the currents from the resistors R42 and R43, less the current through the sensor R44. However, the sensor has a resistive value of approximately 470 ohms at ambient temperature and is variable therefrom as an inverse function of the engine's block temperature deviation from ambient temperature. Hence, at ambient temperature, when the values of the resistor R42 and the sensor R44 are approximately equal, the reference current is equal to the current flowing from the resistor R43. The value of the resistor R43 is predetermined to provide a reference current having a magnitude equal to that of the trigger current after the capacitor C20 has been charging for a preheat time period of approximately 7 seconds.

Initially, when the trigger current is less than the reference current, the signal at the output terminal of the amplifier A1 will be at its positive saturation limit. This output signal forward-biases a diode D24 (type 1N458A) enabling current flow to the filament switching circuit comprising a transistor Q9 (type 2N4921) and a resistor R45 (470 ohms). Current flowing from the diode D24 flows through the resistor R45 into the base of the transistor Q9 resulting in a collector current flow from the battery B through the windings of the relay RY. Such current flow energizes the relay RY which closes the normally-open relay switch S2 enabling current flow from the battery B to the filament F. However, as soon as the trigger current exceeds the reference current, the signal at the output terminal of the amplifier A1 rapidly flips to its negative saturation limit. This signal reverse-biases the diode D24 disabling collector current flow through the relay RY which enables the relay switch S2 to return to its normally-open state thereby deenergizing the filament F.

The signal switching comprises the operational amplifier A3, a transistor Q10 (type 2N4890), and resistors R46, R50 and R49 (each 4.7 Kohms), and resistors R47 and R48 (both 47 Kohms) and R51 (470 ohms). The trigger current, as described above, also flows through the resistor R46 to the noninverting terminal of the amplifier A3, while the reference current, also described above, flows through the resistor R47 to the grounded resistor R48 and the resistor R49, the other end of which is connected to the inverting terminal of the amplifier A3. Initially, when the trigger is less than the reference current, the signal at the output terminal of the amplifier A3 will be at its positive saturation limit. This output signal flows through the resistor R50 to the resistor R51 and to the base of the transistor Q10 which enables collector current flow from the diode D23 and the resistor R51 to energize a wait-lamp L at the same time the filament F is energized. However, since the reference current ot the inverting terminal of the amplifier A3 is reduced by voltage division across the resistors R47 and R48, the trigger current exceeds the reduced reference current and flips the signal at the output terminal to its negative saturation limit before the signal at the output terminal of the amplifier A1 flips to its negative saturation limit. Hence, this output signal deactivates the transistor Q10 enabling the wait-lamp L to be deenergized a short period of time before the filament F is deenergized. Referring to FIG. 2, the apparatus A" operates in the same manner during the preheat period as does the apparatus A described hereinabove, except that application of battery voltage to the wait-lamp L is prevented by the amplifier A3 a short time before the filament F is deenergized, as illustrated by a dashed line e. To preclude overheating the filament F after it reaches the design temperature, T (dashed portion of curve b), the application of the battery voltage to the filament F is prevented by the amplifier A1 after a predetermined preheat time period of approximately seven seconds.

Although the preheat time period is, as stated, approximately seven seconds, it varies as an inverse relation with the voltage of the battery B. As discussed above, the rate of charge of the capacitor C20 is proportionally dependent upon the voltage delivered by the battery B. For example, when the voltage decreases, the capacitor charges at a slower rate causing a longer period of time to elapse before the trigger current exceeds the reference current. Hence, a decreased battery voltage is applied to the filament F for an increased preheat time period to achieve the same design temperature, T, that would have been achieved had the battery voltage not decreased. The preheat time period also varies as an inverse relation with the engine's block temperature deviation from ambient temperature. As discussed above, the resistive value of the sensor R44 is 470 ohms at ambient temperature and is variable therefrom as an inverse function of the engine's block temperature deviation from ambient temperature. Therefore, when the temperature of the engine increases from ambient temperature, the resistive value of the sensor R44 decreases from 470 ohms causing a decrease in the reference current. As a result, a shorter period of time elapses before the trigger current exceeds the reduced reference current. Hence, the battery voltage is applied to the filament F for a decreased preheat time period to achieve the same design temperature, T, that would have been achieved had the temperature of the engine block not increased. The preheat time period varies in a similar inverse relation to an increased battery voltage, as well as it does to a decreased block temperature deviation from ambient temperature.

Just before the preheat period expires, the wait-lamp L is deenergized to apprise the operator that the engine is ready to start, as discussed above. To give the operator enough time to start the engine after the preheat time period, the apparatus A also comprises a pulse generator circuit for alternately applying the battery voltage and then interrupting application of the battery voltage to the filament F. This is done in a cyclic fashion to maintain the design temperature T, of the filament F for a prestart time period not to exceed a predetermined value. The pulse generator circuit is one known in the art and comprises the operational amplifier A2; diodes D26 and D27 (both type 1N458A); a capacitor C21 (5 microfarads); and, resistors R52 (470 Kohms), R53 (560 kohms), R55 (100 Kohms), R56 (4.7 Mohms) and R57 (2.8 Mohms). The pulse generator circuit is inoperative during the preheat time period because the signal from the output terminal of the amplifier A1 forward-biases a diode D25 (type 1N458A) enabling current flow through a resistor R54 (10 Kohms) to the inverting terminal of the amplifier A2 to suppress any signal from the output terminal thereof. However, when the signal from the output terminal of the amplifier A1 goes flips and reverse-biases the diode D25, the amplifier A2 becomes functional. Current from the output terminal of the amplifier A2 flows to the resistor R52 and the diode D26 enabling flow of current to the resistor R53. The current flowing from the resistors R52 and R53 flows to the grounded capacitor C21 and through the resistor R55 to the inverting terminal of the amplifier A2. Current flowing from the voltage regulator VR through the resistor R57 biases the noninverting terminal of the amplifier A2 to produce a signal at the output terminal thereof which forward-biases the diode D27 enabling current flow through the resistor R45 to the base of the transistor Q9 which ultimately causes the relay RY to energize the filament F as described above.

As the capacitor C21 is being charged, current applied through the resistor R55 to the inverting terminal of the amplifier A2 increases from zero. When the current being applied to the inverting terminal of the amplifier A2 exceeds the current being applied to the noninverting terminal, the signal at the output terminal of the amplifier A2 reverse-biases the diode D27 disabling collector current flow of the transistor Q9 which ultimately causes the relay RY to deenergize the filament F as described above. This cycle of energizing, then deenergizing the filament F, as illustrated in FIG. 2 by a pulse in time period c, repeats to produce a train of voltage pulses for application to the filament F. This modulating action limits the average power to maintain the design temperature of the filament F without overheating it. The repetition frequency is controlled by the values of the capacitor C21 and the resistances R52 and R53; the diode D26 prevents the resistor R53 from influencing the discharge cycle of the capacitor C21. Current flowing from the output terminal of the amplifier A2 also flows to its noninverting terminal through the resistor R56 which assures the generation of a square-edged pulse. The ratio of the pulse width to that of the space width is equal to the ratio of the resistive value of the parallel combination of the resistors R52 and R53 to the value of the resistor R52.

The prestart circuit disables modulation after a maximum prestart time period of approximately 30 seconds and comprises the operational amplifier A4; a transistor Q11 (type 2N3906); a zener diode ZD6 (type 1N756) and a diode D28 (type 1N458A); a capacitor C22 (5 microfarads); and, resistors R58 and R59 (both 10 Kohms), R60 (68 Kohms), and R61 and R62 (both 4.7 Mohms). The 30 second time period begins when the signal from the output terminal of the amplifier A1 flips to its negative saturation limit and flows through the resistor R58 to the zener diode ZD6 which becomes conductive and enables current flow to the biasing resistor R59 and the base of the transistor Q11. As a result, emitter current flow from the diode D23 and the resistor R59 enables current flow through the resistor R60 to the grounded capacitor C22 and the resistor R61, the other end of which is connected to the inverting terminal of the amplifier A4. Current flowing from the voltage regulator VR through the resistor R62 biases the noninverting terminal of the amplifier A4 at a predetermined value equal to the magnitude of the current applied to the inverting terminal of the amplifier A4 after the capacitor C22 has been charging for a prestart timer period of approximately 30 seconds. When this predetermined value is exceeded by the current flow into the inverting terminal of the amplifier A4, the voltage output therefrom forward-biases the diode D28 enabling current flow through the resistor R54 to the inverting terminal of the amplifier A2 to suppress any signal from the output terminal thereof.

Since the pulse generator circuit is shut down and the filament F is deenergized, the apparatus A" cannot be restarted until the movable wiper contact W1 of the ignition switch S1 is turned back from the PREHEAT position 2 to the OFF position 1. When the operator returns the movable wiper contact W1 of the ignition switch S1 to the PREHEAT position 2 immediately after the prestart period, the filament F would be reheated to a temperature greater than the design temperature before it was able to cool down to ambient temperature. However, the temperature sensor R44 prevents such overheating of the filament F, as described above. If, however, the operator engages the starter ST by turning the wiper contact W1 of the ignition switch S1 from the PREHEAT position 2 to the START position 3 before the prestart period expires, current flows from the battery B through a resistor R64 (47 Kohms) to a grounded resistor R63 (10 Kohms) and a capacitor C23 (0.01 microfarad) having an output end connected to a grounded resistor R65 (10 Kohms) and the base of a transistor Q12 (type 2N5449). The collector of the transistor Q12 is connected to the grounded capacitor C22. The voltage across the resistor R63 is integrated by the capacitor C23 enabling current flow to the base of the transistor Q12. When the transistor Q12 is activated, the capacitor C22 discharges and recycles the prestart circuit to continue modulation of the battery voltage to the filament F for an afterglow period of approximately 30 seconds. Therefore, if the engine starts, the glow plugs remain heated while the engine is operating. The afterglow period is predetermined by the amount of time required for smooth engine idling and to minimize engine noise and white smoke emission.

It will be apparent that various changes may be made in details of connecting and programming the electronic components as shown in the attached drawings and disclosed in conjunction therewith without departing from the spirit and scope of this invention as defined in the appended claims. It is, therefore, to be understood that this invention is not to be limited to the specific details shown and described.

What we claim is:

1. Apparatus controlled by an ignition switch for energizing a normally-open power switch to enable application of power from an associated power source to a heater filament of a glow plug in a diesel engine, the filament being one which is heated to a predetermined design temperature when a specified voltage is applied thereto, the power source having a supply voltage greater than the specified voltage, the ignition switch being operable in a first position to prevent the application of the supply voltage to the apparatus, operable in a second position to apply the supply voltage at a first terminal of the apparatus, and operable in a third position to apply the supply voltage at the first terminal and at a second terminal of the apparatus and to the starter for the engine, the ignition switch further being operable, when turned to the third position and released, to return to the second position, said apparatus comprising:

means operable, after the ignition switch has been turned from the first to the second position, to energize the power switch to cause preheating of the filament for a time period which varies as an inverse function of available supply voltage and equals the time required to raise the temperature of the filament from ambient temperature to the design temperature, means operable, after the preheat time period, to maintain the filament at the design temperature for a prestart time period by alternately energizing and then de-energizing the power switch in repetitive fashion, and means operable, after the ignition switch has been turned from the second to the third position, to continue alternately energizing and then de-energizing the power switch for an afterglow time period predetermined by the amount of time required for smooth engine idling and to minimize engine noise and white smoke emission.

2. Apparatus as recited in claim 1 which additionally includes signal means operable to energize a sensory signal when the supply voltage is applied thereto, wherein said first-named means is operable to apply the supply voltage to said signal means for the preheat time period.

3. Apparatus as recited in claim 2, wherein said power switch energizing means comprises:

switching means operable, when activated, to energize and, when deactivated, to deenergize the power switch, means operable, when the supply voltage is applied at the first terminal of said apparatus, to establish a reference current and a trigger current which increases in magnitude at a rate varying as a proportional function of the available supply voltage from below to above that of the reference current, and a first comparator operable to cause preheating by activating said switching means when the magnitude of the trigger current is less than that of the reference current, and to terminate preheating by deactivating said switching means when the magnitude of the trigger current exceeds that of the reference current.

4. Apparatus as recited in claim 3, wherein said means operable to maintain filament temperature comprises:

an astable multivibrator operably associated to be enabled by said first comparator when the magnitude of the trigger current exceeds that of the reference current, and operable, when enabled, to activate and then deactivate said switching means in repetitive fashion, means operably associated to be enabled by said first comparator when the magnitude of the trigger current exceeds that of the reference current, and operable when enabled, to establish a fixed current and a variable current which increases in magnitude from below to above that of the fixed current, and a second comparator operable to disable said multivibrator when the magnitude of the variable current exceeds that of fixed current.

5. Apparatus as recited in claim 4 which additionally includes means operable to vary the magnitude of the reference current as an inverse function of the deviation of engine temperature from a reference temperature.

6. Apparatus as recited in claim 1 which additionally includes signal means operable to energize a sensory signal when the supply voltage is applied thereto, wherein said power switch energizing means is operable to apply the supply voltage to said signal means for the preheat time period, and wherein said power switching energizing means comprises:

switching means operable, when activated, to energize and, when deactivated, to deenergize the power switch, a preheat flip-flop having set and reset input terminals and an output terminal connected to said switching means, means operable, when the supply voltage is applied at the first terminal of said apparatus, to apply a signal to the set terminal of said preheat flip-flop activating said switching means, oscillator means for establishing pulses at a repetition frequency which varies as a proportional function of the available supply voltage being applied thereto when the supply voltage is applied at the first terminal of said apparatus, and a master counter operably connected to receive pulses from said oscillator means and operable, after receiving a first predetermined number of pulses over a period of time which equals the preheat time period, to apply a signal at the reset terminal of said preheat flip-flop deactivating said switching means.

7. Apparatus as recited in claim 6, wherein said means operable to maintain filament temperature comprises:

a flip-flop operably connected, in response to a signal from said master counter, to activate said switching means, and a counter operable, in response to a predetermined number of signals from said master counter, to deactivate said switching means, and wherein said master counter, after it has deactivated said switching means at the end of the preheat time period, is operable alternately to apply a signal to said flip-flop in response to a second predetermined number of pulses from said oscillator and to apply successive signals to said counter in response to third predetermined numbers of pulses from said oscillator.

8. Apparatus as recited in claim 7, wherein said master counter, after receiving a predetermined number of pulses, is operable to disable said oscillator means and to apply a signal at a reset terminal of said flip-flop to deactivate said switching means.

9. Apparatus as recited in claim 8 which additionally includes means operable, after the ignition switch has been turned from the second to the first position, to prevent energization of the power switch by said power switch energizing means for a predetermined period of time.

10. Apparatus as recited in claim 9 wherein said means named third in claim 1 is not operable until the ignition switch has returned from the third to the second position.

11. Apparatus as recited in claim 1 wherein said second-named means varies the ratio of the time the power switch is energized to the time it is deenergized as an inverse function of the available supply voltage.

* * * * *